US007866153B2

(12) United States Patent
Sollie et al.

(10) Patent No.: US 7,866,153 B2
(45) Date of Patent: Jan. 11, 2011

(54) DISPLACER PISTON ASSEMBLY

(75) Inventors: Per D. Sollie, Sheffield (GB); Lars Kjosbakken, Sheffield (GB); Sven Erik Fossum, Sheffield (GB); Eldar Onsøyen, Sheffield (GB); Sverre Johansen, Sheffield (GB)

(73) Assignee: Somemore Limited, London (GB)

( * ) Notice: Subject to any disclaimer, the term of this patent is extended or adjusted under 35 U.S.C. 154(b) by 491 days.

(21) Appl. No.: 11/912,507

(22) PCT Filed: Apr. 26, 2006

(86) PCT No.: PCT/GB2006/001519

§ 371 (c)(1),
(2), (4) Date: May 22, 2008

(87) PCT Pub. No.: WO2006/114620

PCT Pub. Date: Nov. 2, 2006

(65) Prior Publication Data

US 2008/0282695 A1 Nov. 20, 2008

(30) Foreign Application Priority Data

Apr. 26, 2005 (GB) ..... 0508447.0

(51) Int. Cl.
*F01B 29/10* (2006.01)

(52) U.S. Cl. ..... 60/517

(58) Field of Classification Search ..... 60/517–526; 92/176, 225

See application file for complete search history.

(56) References Cited

U.S. PATENT DOCUMENTS

| | | | | | |
|---|---|---|---|---|---|
| 4,417,444 | A | * | 11/1983 | Lundholm | 60/525 |
| 4,452,042 | A | * | 6/1984 | Lindskoug | 60/517 |
| 4,593,608 | A | * | 6/1986 | Corey et al. | 92/176 |
| 4,736,586 | A | | 4/1988 | Kawajiri et al. | |
| 5,865,091 | A | * | 2/1999 | Domanski et al. | 92/177 |
| 2004/0129133 | A1 | | 7/2004 | Kiikka | |

FOREIGN PATENT DOCUMENTS

| | | |
|---|---|---|
| FR | 1136251 | 5/1957 |
| JP | 61040452 | 2/1986 |
| JP | 610400451 | 2/1986 |
| WO | 9105949 | 5/1991 |

* cited by examiner

*Primary Examiner*—Hoang M Nguyen
(74) *Attorney, Agent, or Firm*—Gifford, Krass, Sprinkle, Anderson & Citkowski, P.C.

(57) ABSTRACT

A split displacer piston assembly (1) in conjunction with a Stirling engine is disclosed. Said assembly comprises of two main parts, displacer dome (8) and displacer base (9). Within the displacer dome there are several heat shields (10). The displacer base has a piston ring assembly (12) installed in an outer perimeter groove and fixed between the displacer base and displacer dome is a displacer guide ring (11). In order to service and or replace these parts rapidly, the displacer dome and displacer base are fastened by threaded engagement.

6 Claims, 6 Drawing Sheets

DISPLACER PISTON ASSEMBLY

TECHNICAL FIELD OF THE INVENTION

The invention relates to a displacer piston assembly. The invention has particular applicability to Stirling engines.

BACKGROUND OF THE INVENTION

Stirling engines offer advantages of multi-fuel capabilities (geothermal, solar, bio-, fossil- and nuclear fuel), very low $NO_x$ and HC emissions when burning fossil fuels, very high total efficiency (particularly when used with CHP), and very low maintenance compared to internal combustion engines.

The principle of operation of a Stirling engine can be described with reference to FIG. 1. A displacer (a) and power piston (b) reciprocate within a cylinder with a fixed charge of working gas (e.g. air, nitrogen, helium or hydrogen). The displacer and power piston are connected to a crankshaft (c) via crossheads, connecting rods (d) and wristpins. As the displacer (a) reciprocates, it displaces the working gas (usually nitrogen or helium in production engines) through the heater head tubes (e), regenerator (f) and cooler (g) that are placed in the hot and cold portions of the engine. The displacer (a) and power piston (b) have different phase angles so that more work is put into the power piston during the expansion stroke, when most of the gas is in the hot space, than the work the piston returns to the gas a cycle later to compress cold gas back to the hot part of the engine. The net surplus of expansion work over compression work is extracted as useful work by the power piston, which in turn is transferred to the crankshaft (c) with its outgoing shaft. All external heat is supplied at the heater head (e) and rejected in the cooler (g). The regenerator (f) absorbs heat from the working gas as the gas moves from the hot end to the cold end. It returns the stored heat to the working gas when the gas is pushed from the cold end to the hot end. One can say that the regenerator acts as a "thermal dynamic sponge".

In a β-type (or commonly called displacer type) engine, there is a power piston and displacer piston coaxially located within the same working cylinder. In order to move the displacer piston, a displacer rod is coaxially positioned through the centre bore of the power piston. The displacer rod is fastened to the displacer base and displacer crosshead. There arises a need to seal the displacer rod from the power piston. This can be accomplished with various sealing arrangements.

There also arises a need to seal the displacer piston between the hot and cold gas circuit of the Stirling process. This is usually accomplished by means of piston ring assemblies. In addition, due to the oscillating motion of the power piston, there is also a need to take up any side forces that can occur between the displacer piston and its working cylinder. These side forces are usually dealt with by using a guide ring (or commonly called Rider Ring) that is shrink fitted (in a groove) onto the displacer piston and thereafter turned to its correct diameter (slightly smaller than the working cylinder diameter).

The sequence of heating up, fitting, cooling and turning the displacer guide ring to its final diameter is a time consuming and expensive process.

US 2004/0129133 A1 discloses a displacer type (beta) Stirling engine with a displacer and sealing assembly. The sealing assembly comprises a displacer with a machined recess or step, a rod, a seal and a retaining ring. The seal is axially positioned and placed concentric into the displacer step and the retaining ring is installed in a position in which no axial forces act upon the seal. This allows the seal to move axially and radially during operation. While engines according to this publication may function properly, there is no seal/guide ring that can accept side forces that can occur in a displacer type Stirling engine.

Since a non-lubricated beta type engine can from time to time experience wear problems in the displacer piston sealing assembly, there is a need for a displacer piston sealing assembly that is compact, accessible and easy serviceable. In order to service and/or replace these parts rapidly, the displacer piston comprises two main components; displacer dome and displacer base that are fastened by threaded engagement.

It is an object of the present invention to provide a Stirling engine with a split displacer piston assembly.

DISCLOSURE OF THE INVENTION

In accordance with the present invention a Stirling engine comprises an oscillating assembly with a displacer piston assembly, displacer rod, displacer crosshead and a power piston assembly that is connected to the power piston crosshead. For ease of construction the displacer piston assembly is split into two parts, a displacer dome and a displacer base. The displacer base and displacer dome are mounted together by means of threads. When this assembly is screwed together it also holds the displacer guide ring in place.

The invention provides a displacer piston assembly comprising a displacer dome, a displacer base, displacer piston rings and a displacer guide ring, where said displacer dome and displacer base are held together by corresponding internal and external threads, wherein the displacer dome has a shoulder L1 with length L1 and diameter D and the displacer base has a shoulder S2 with length L2 and diameter D2, and the diameter D is approximately equal to the diameter D2, in which the displacer guide ring is positioned between the shoulders, and in which the lengths L1 and L2 are less than the length L4 of the displacer guide ring.

It is preferred that that at one heat shield is fastened to the displacer dome concentrically within the inner surface of the displacer dome to form a hollow cavity (C1).

Preferably the displacer dome is slightly tapered, the largest diameter being at the open side of the displacer dome and the smallest diameter being at the closed side of the displacer dome.

The displacer guide seal (11) and/or the displacer piston rings (12) may be of a polyamide material Vespel SP-211, Meldin™ or Rulon™.

The invention includes a Stirling engine having a displacer piston assembly according to any one of the preceding paragraphs in the Disclosure of Invention

DESCRIPTION OF A SPECIFIC EMBODIMENT OF THE INVENTION

Figure 1:
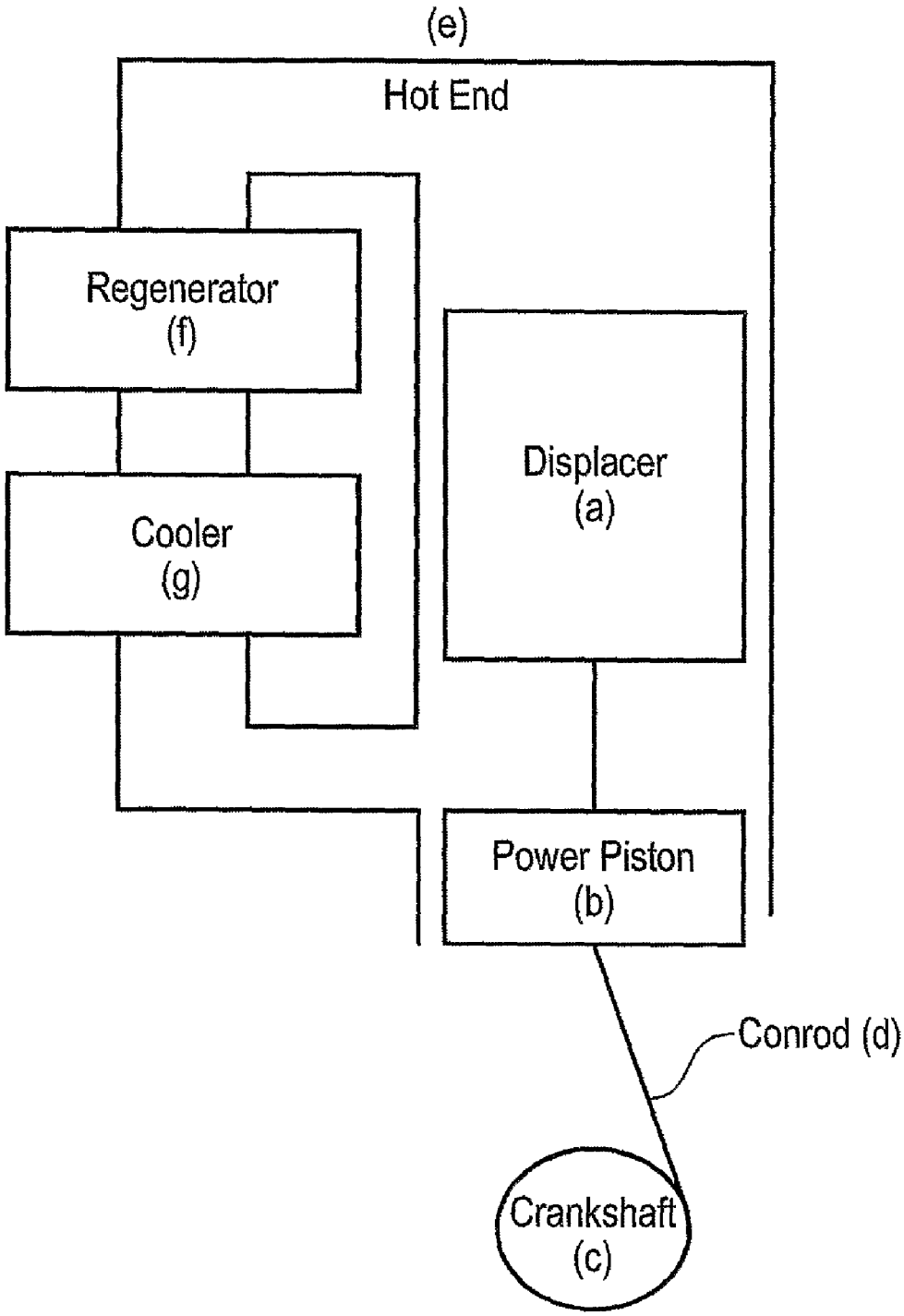
FIG. 1 shows a simplified Stirling engine.
Figure 2:
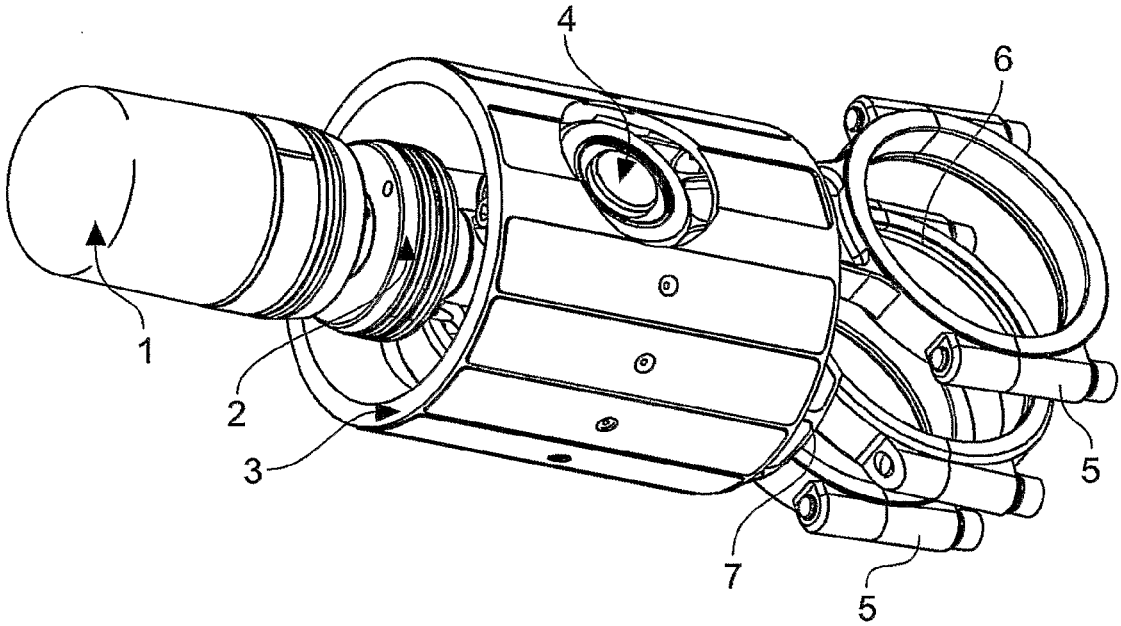
FIG. 2 is a perspective view of the Oscillating assembly.

FIG. 2 is a perspective view of the Oscillating assembly within a Stirling engine. Displacer piston 1 is shown with its sealing arrangement. The displacer piston 1 is fastened to a displacer rod (not shown in this figure, see FIG. 4, item 14). The displacer rod is fastened to a power crosshead wrist pin 4 with needle bearings. The power crosshead wrist pin 4 is fixed to a power crosshead 3.

Fixed to the power crosshead 3 there are two power connecting rods 5. These connecting rods 5 are split, have roller bearings and are mounted to a traditional crankshaft (not shown).

The displacer rod (not shown in this figure, see FIG. 4, part 14 for clarity) is concentrically placed with respect to the power piston 2 and the displacer piston 1. The displacer rod is fastened to the displacer crosshead 7. The displacer crosshead 7 has its own wrist pin, which in turn is fixed to the displacer connecting rod 6. The displacer connecting rod 6 is split, has a roller bearing and is mounted to the same crankshaft as the power connecting rods 5.

Figure 3:
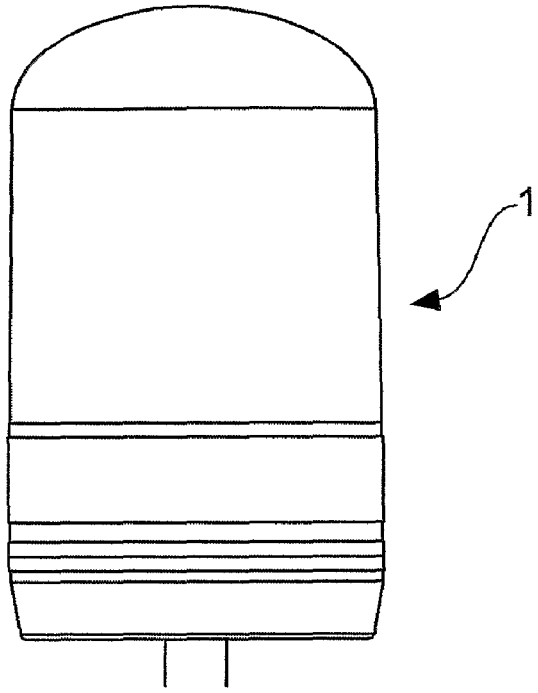
FIG. 3 is a side view of a displacer piston assembly.

FIG. 3 is a side view of the displacer piston 1. A much better and more descriptive view is obtained by looking at FIG. 4.

Figure 4:
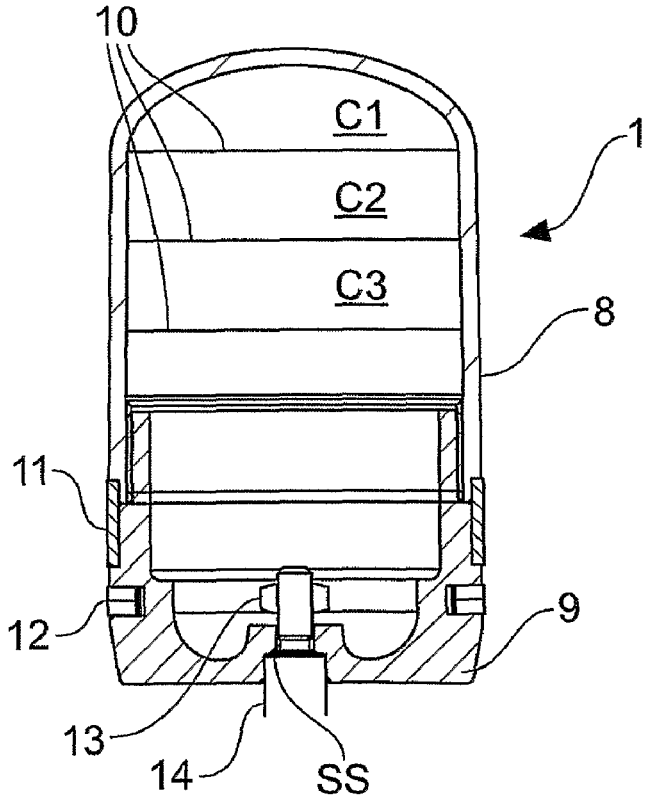
FIG. 4 is a sectional view of the displacer piston assembly.

FIG. 4 is a sectional view of the displacer piston 1. The piston 1 comprises two main parts; displacer dome 8 and displacer base 9. Within the displacer dome 8 there are several heat shields 10. These heat shields 10 are fixed to the inner portion/surface of the displacer dome 8 by means of brazing or welding. The total number of heat shields 10 depends upon the working pressure and temperature within the Stirling process. Said heat shields 10 form hollow internal cavities C1, C2, C3 that serve as thermal resistors, which thermally isolate the opposing ends of the displacer piston 1. The plate thickness of said heat shield 10 may be around 0.3 mm.

The displacer base 9 has a piston ring assembly 12 installed in an outer perimeter groove. This groove is included in the description of FIGS. 6 and 7. As the displacer piston 1 reciprocates in its bore, the piston ring assembly 12 functions as a seal between the hot and cold gas circuits of the Stirling process.

The displacer base 9 is connected to the displacer rod 14 by means of a nut 13. As shown, the displacer rod rests against a stepped shoulder SS within the displacer base 9. The displacer base 9 is fastened onto displacer dome 8 through threaded engagement. When this assembly is screwed together it also holds the displacer guide ring 11 in place.

Figure 5:
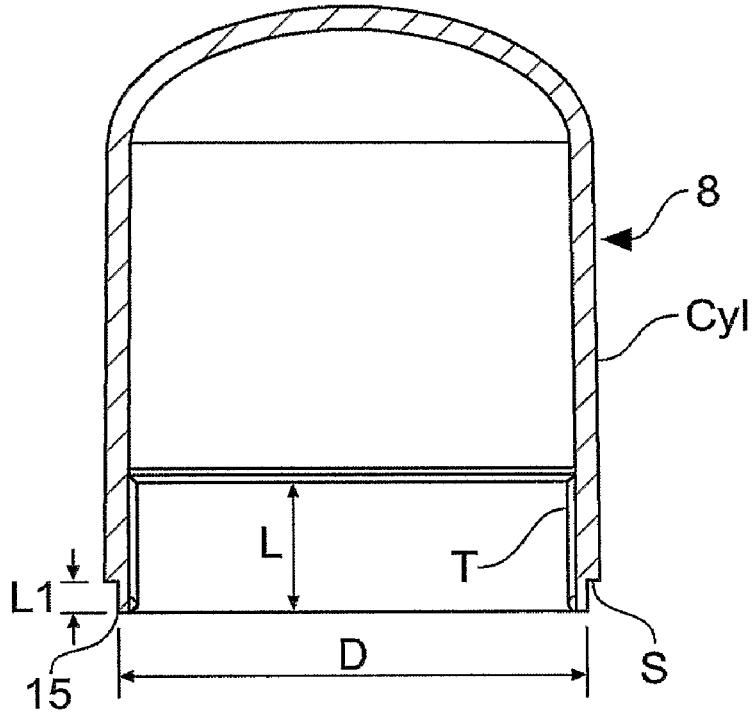
FIG. 5 is a sectional view of the displacer piston dome.

FIG. 5 is a sectional view of the displacer piston dome 8. The top of the displacer piston dome 8 has a characteristic elliptic diametric cross section. The cylindrical portion Cyl of the displacer dome 8 can be straight or preferably slightly tapered. A tapered shape is preferred since the maximum working temperature within the hot gas circuit of the Stirling process can get as high as 750° C. At the same time the temperature on the cold gas circuit of the Stirling process is around 150° C. This means that the temperature difference between the top portion of the displacer dome and the bottom portion can be as much as 600° C. The tapered shape will reduce the danger of wedging or galling of the displacer dome 8 within the working cylinder. Also, due to the high temperature difference between the top and bottom portions of the displacer piston, this is also the reason for placement of heat shields 10 within the displacer dome 8. This solution drastically reduces heat radiation.

Within the displacer dome 8 there is a certain length L of threads T. As will be described later these threads T engage with threads t of the displacer base 9. These threads T have enough length for strength purposes.

For clarity, the heat shield(s) 10 are not shown in this sectional view.

At the bottom of the displacer dome 8 there is a shoulder S with a given length L1 and a given diameter D.

Figure 6:
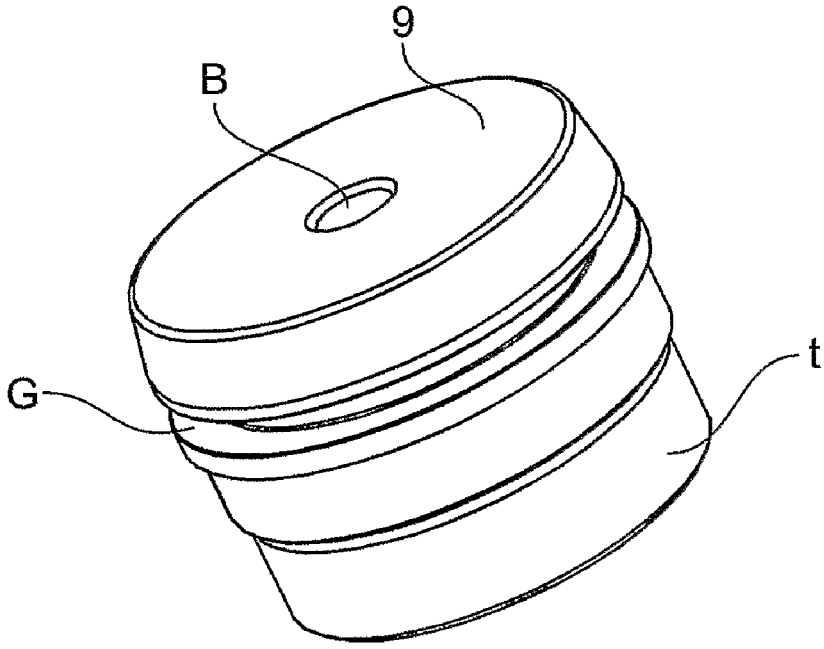
FIG. 6 is a perspective view of the displacer piston base.

FIG. 6 is a perspective view of the displacer base 9. The base 9 has a concentric bore B that permits the displacer rod 14 to penetrate in order to be fastened and secured by a nut 13. Said bore B can be conically drilled or have a shoulder as shown in FIG. 4.

A groove G is added to the displacer base 9. Said groove G is turned and machined in order to permit mounting of a piston ring assembly 12. Threads t on the outer diameter surface are machined in order to permit mounting with displacer dome 8.

Figure 7:
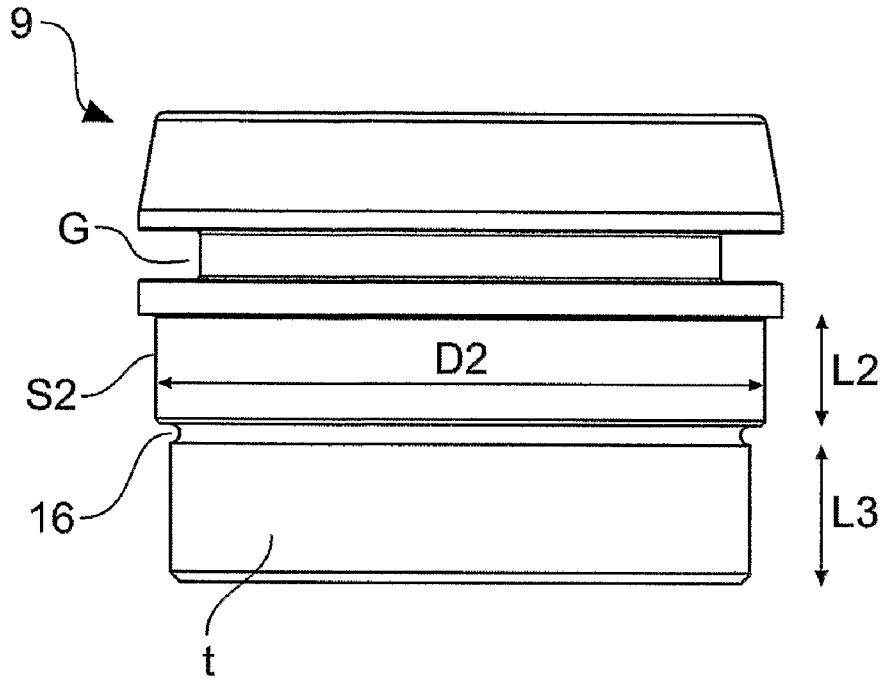
FIG. 7 is a side view of the displacer piston base.

FIG. 7 is side view of the displacer base 9. The figure depicts a shoulder S2 located just above the threaded portion t. Said shoulder S2 has a diameter D2 that is equal to the diameter D of shoulder S on the displacer dome 8. The diametrical difference between the threaded portion t and shoulder diameter D2 represents a flat surface 16. When threading the displacer base 9 into the displacer dome 8 threads t and T mesh into each other. These threads t, T are identical e.g. M58. The displacer base 9 is screwed into the displacer dome 8 until the flat surface 16 engages with the flat surface 15 of the displacer dome 8.

Figure 8:
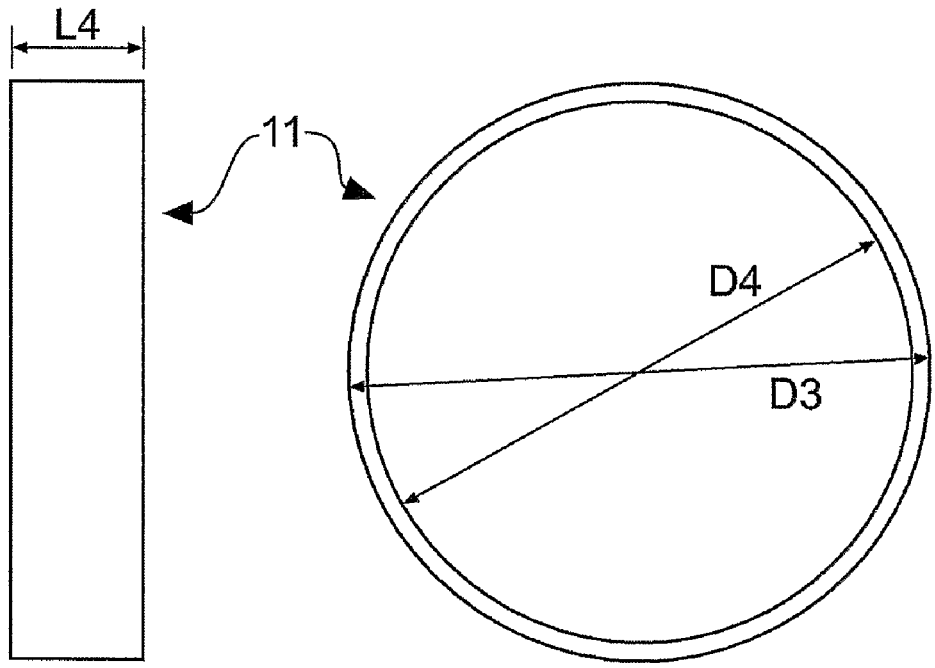
FIG. 8 is two views of the displacer guide ring.

FIG. 8 is a plan and side view of the displacer guide ring 11. Another commonly used term for this part is a Rider Ring. The displacer guide ring's purpose is to take up any side forces that arise during operation. Additionally it may also serve as an extra seal since it will resist a differential pressure across its length L4. The displacer guide ring 11 has a given height or length L4. The outer diameter is designated D3 and the inner diameter is designated D4.

The inner diameter D4 is equal to or slightly larger than the shoulder diameter D of the displacer dome 8 and shoulder diameter D2 of the displacer base 9. This is to ensure easy installation of the displacer guide ring 11 making it a slip on fit.

The outer diameter D3 is machined/turned slightly smaller than the working cylinder diameter. This is to endure that the displacer piston can freely oscillate within the working cylinder.

The length L4 of the displacer guide ring 11 is equal to or slightly larger than the combined length of the displacer base shoulder length L1 and the displacer base shoulder length L2. The reason for this is to axially fix the displacer guide ring 11 when the displacer dome 8 is screwed in place into the displacer base 9.

Figure 9:
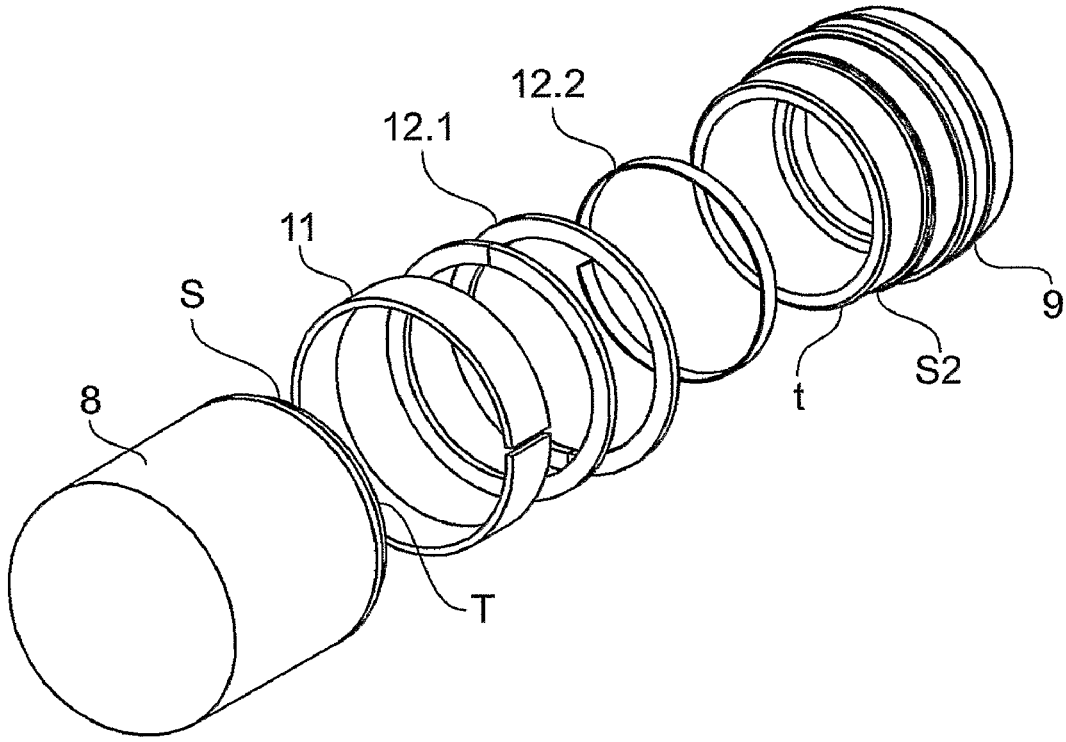
FIG. 9 is an exploded view of the displacer piston assembly

FIG. 9 is an exploded view of the displacer piston 1. This figure shows how the different parts are assembled.

First, the displacer guide ring 11 is placed onto the displacer base shoulder S2. Then the displacer dome 8 is screwed into the displacer base 9, where said displacer dome and displacer base are held together by corresponding internal and external threads (t and T), wherein the displacer dome (8) has a shoulder S1 with length L1 and diameter D and the displacer base (9) has a shoulder S2 with length L2 and diameter D2, and the diameter D is approximately equal to the diameter D2, and in which the displacer guide ring (11) is positioned between the shoulders S1 and S2 and where the lengths L1 and L2 are less than the length L4 of the displacer guide ring (11).

Thereafter, the assembly with displacer guide ring (11) is machined by turning to a diameter slightly less than the displacer cylinder (not shown for clarity reasons). This diameter has been calculated (and validated during testing) to take into account thermal expansion during engine operation. The displacer guide ring (11) is now basically concentric to the displacer piston and its base.

At last, the piston ring assembly 12, comprising piston ring 12.1 and piston ring spring 12.2, is assembled onto the displacer base 9. Said piston ring assembly 12 slips in place into groove G as shown in FIG. 6. Said piston rings will be able to account for minor non-concentric machining such as displacer dome, base or displacer cylinder.

The invention claimed is:

1. A displacer piston assembly comprising a displacer dome, a displacer base, displacer piston rings and a displacer guide ring, in which said displacer dome and displacer base are held together by corresponding internal and external threads, in which the displacer dome has a shoulder (S1) with length L1 and diameter D and the displacer base has a shoulder S2 with length L2 and diameter D2, and the diameter D is approximately equal to the diameter D2, and in which the displacer guide ring is positioned between the shoulders S1 and S2 in which the lengths L1 and L2 are less than the length L4 of the displacer guide ring.

2. A displacer piston assembly as claimed in claim 1, in which at least one heat shield is fastened to the displacer dome concentrically within the inner surface of the displacer dome to form a hollow cavity.

3. A displacer piston assembly as claimed in claim 1, in which the displacer dome is slightly tapered, the largest diameter being at the open side of the displacer dome and the smallest diameter being at the closed side of the displacer dome.

4. A displacer piston assembly as claimed in claim 1, in which the displacer guide seal is of polyamide material.

5. A displacer piston assembly as claimed in claim 1, in which the displacer piston rings are of polyamide material.

6. A Stirling engine having a displacer piston assembly according to claim 1.

* * * * *